United States Patent [19]

Schippers et al.

[11] Patent Number: 5,016,829

[45] Date of Patent: May 21, 1991

[54] TAKEUP MACHINE

[75] Inventors: Heinz Schippers; Erich Lenk; Siegmar Gerhartz, all of Remscheid; Herbert Schiminski, Huckeswagen; Herbert Turk, Remschied, all of Fed. Rep. of Germany

[73] Assignee: Barmag AG, Remscheid, Fed. Rep. of Germany

[21] Appl. No.: 427,122

[22] PCT Filed: Feb. 17, 1989

[86] PCT No.: PCT/DE89/00094

§ 371 Date: Oct. 18, 1989

§ 102(e) Date: Oct. 18, 1989

[87] PCT Pub. No.: WO89/07573

PCT Pub. Date: Aug. 24c 1989

[30] Foreign Application Priority Data

Feb. 20, 1988 [DE] Fed. Rep. of Germany ..... 3805347

[51] Int. Cl.[5] ..... B65H 67/048

[52] U.S. Cl. ..... 242/18 A; 242/18 PW

[58] Field of Search ..... 242/18 A, 18 PW, 18 DD, 242/25 A

[56] References Cited

U.S. PATENT DOCUMENTS

| | | | |
|---|---|---|---|
| 3,708,133 | 1/1973 | McErlane et al. | 242/18 A |
| 3,913,852 | 10/1975 | Lenk et al. | 242/18 A |
| 4,033,519 | 7/1977 | Abe et al. | 242/18 A |
| 4,210,293 | 7/1980 | Fromaget | 242/18 A |
| 4,216,920 | 8/1980 | Tambara et al. | 242/18 A |
| 4,431,138 | 2/1984 | Schiminski et al. | 242/18 A |
| 4,505,436 | 3/1985 | Schippers et al. | 242/43 A |
| 4,867,385 | 9/1989 | Lenk | 242/18 A |

FOREIGN PATENT DOCUMENTS

| | | |
|---|---|---|
| 3425064 | 1/1989 | Fed. Rep. of Germany . |
| 3513796 | 6/1989 | Fed. Rep. of Germany . |
| 49-100351 | 9/1974 | Japan . |

*Primary Examiner*—Stanley N. Gilreath

*Attorney, Agent, or Firm*—Bell, Seltzer, Park & Gibson

[57] ABSTRACT

A winding apparatus is disclosed which includes a rotatable revolver having a pair of spindles mounted thereon, with the spindles being adapted to coaxially mount one or more bobbin tubes. Upon rotation of the revolver, the spindles are moved between a winding position and a doffing position, and a traversing mechanism is provided for traversing an advancing yarn and so as to form a cross wound package on the tubes at the winding position. Means are also provided for automatically transferring the advancing yarn from the rotating full package which has been moved to the doffing position, to a rotating empty bobbin tube on a spindle which has been moved to the winding position, and which comprises a yarn lifting device for removing the advancing yarn from the traversing means and conveying the advancing yarn laterally to a yarn catching plane, and a yarn transferring mechanism which laterally deflects the yarn from the yarn catching plane to a bead plane which is within the normal traverse stroke.

11 Claims, 9 Drawing Sheets

TAKEUP MACHINE

BACKGROUND OF THE INVENTION

The invention relates to a yarn winding apparatus for continuously winding an advancing yarn onto bobbin tubes serially delivered to a winding position. An apparatus of this type is disclosed in European Patent Application 5664 and U.S. Pat. No. 4,210,293.

In copending and commonly owned U.S. application Ser. No. 07/454,723, filed Dec. 21, 1989, a winding apparatus is disclosed wherein the yarn transferring mechanism includes a plate, which is guided between the full and the empty winding spindle and which displaces the yarn in such a manner that the yarn loops a substantial distance about the empty bobbin tube on the winding spindle to facilitate the catching of the yarn by the catching slot on the bobbin tube. Also, this winding apparatus serves to wind a continuously advancing yarn without waste.

According to the German Patent 32 11 603, and U.S. Pat. No. 4,431,138, the problem of transferring a yarn loss free from a full package to an empty tube and of causing it to be caught by the latter is solved in that the yarn is removed from a yarn traversing mechanism and guided into a normal plane in which a yarn catching slot of the bobbin tube is located, which is placed on the empty spindle. Simultaneously, the full package is axially displaced in such a manner that the yarn advancing in the catching plane continues to wind on the full package. The empty spindle is also moved into the yarn path between the yarn traversing mechanism and the operating spindle in such a manner that the yarn and the bobbin tube on the empty spindle having the same direction of movement contact each other in the normal plane of the yarn catching slot (i.e. common rotation catching). As a result, it is accomplished that on the one hand the yarn continues to be wound as a bead on the full package, while on the other hand the yarn can be placed into the catching slot provided in the empty tube. However, the displacement of the winding spindle with full packages becomes a problem of mechanical engineering when packages of a very considerable thickness are wound and/or several, for example, four packages are each formed by one yarn on a winding spindle, which is normally supported in a cantilever fashion.

U.S Pat. No. 3,913,852 describes the so-called counter-rotation yarn catching, which is in contrast to the above-described common rotation yarn catching. In the counter-rotation yarn catching, the yarn advancing to the full package is likewise lifted out of the yarn traversing mechanism and pulled out as a loop by a transferring device. In so doing, the strand of yarn advancing to the transferring device is guided in the plane of a catching slot provided in the empty tube and has there a direction of movement, which upon its contact is opposite to the direction of movement of the empty tube, while the strand of yarn moving away from the transferring means is guided onto the full package and wound to form a bead. Due to the very large deflection of the yarn in the transferring device, the tension in the strand of yarn advancing to the transferring device and the empty tube drops very significantly. This drop of tension is further enhanced in that the empty tube moves against the running direction of the yarn in the zone of the common contact. Although this procedure ensures a reliable catching of the yarn, there also exists the risk that the yarn slackens at the moment it is caught so considerably that the yarn path is disturbed. In particular, laps may form on the feed roll system preceding the takeup machine, thereby causing the winding process to break down.

European Application 88104937.4 and U.S. Pat. No. 4,867,385 disclose a procedure for the reliable catching of the yarn by the common rotation method, wherein the yarn which is pulled off behind the empty spindle is braked in such a manner that it forms a lap on the winding tube of the empty spindle.

It is accordingly an object of the present invention to provide a yarn winding apparatus of the described type which achieves a highly reliable common rotation catching of the yarn, without the displacement of a winding spindle. In so doing, and for the purpose of avoiding changes in the yarn tension, special importance is attached to the fact that the yarn transfer procedure, such as the transfer of the yarn from the full package to the empty tube by catching the yarn on the empty tube, and the tearing or cutting of same from the full package, occurs in such a short time that also the formation of a bead on the full package is kept within narrow limits.

SUMMARY OF THE INVENTION

The above and other objects and advantages of the present invention are achieved in the embodiments described herein by the provision of a yarn winding apparatus which comprises a revolver rotatably mounting at least two spindles having parallel rotational axes, with each spindle being adapted to mount at least one bobbin tube coaxially thereon, and such that each spindle and associated bobbin tube may be selectively moved between a winding position and a doffing position upon rotation of the revolver. Means are provided for winding an advancing yarn onto a bobbin tube at the winding position and including means for rotating the spindle and associated bobbin tube at the winding position, and traversing means mounted at a location upstream of the winding position for traversing an advancing yarn to form a cross wound package. Rotary drive means are provided for selectively rotating the revolver to move each spindle between the winding position and the doffing position, and means are provided for automatically transferring the advancing yarn from the rotating full package which has been moved to the doffing position, to a rotating empty bobbin tube on a spindle which has been moved to the winding position.

In accordance with the present invention, the yarn transferring means comprises yarn lifting means for selectively removing the advancing yarn from the traversing means and then conveying the advancing yarn laterally to a yarn catching plane which is perpendicular to the axes of the spindles and which is located beyond the normal traverse stroke. Also, the yarn transferring means includes yarn shifting means which is selectively movable into an operative position extending into the yarn path between the empty bobbin tube and the full package, and which includes slot means for engaging the advancing yarn and retaining the same in a bead plane which is parallel to the catching plane and is within the normal traverse stroke and so that the yarn advances to the rotating full package in the bead plane. The yarn shifting means also includes yarn displacing means positioned upstream of the slot means for conveying the advancing yarn laterally from the slot means to the yarn catching plane, and such that the advancing yarn runs in the yarn catching plane from the yarn lifting means to the shifting means and so as to be adapted to engage a yarn catching slot in the rotating empty bobbin tube at the winding position and which is located in the yarn catching plane. The advancing yarn is then deflected laterally from the yarn catching plane to the bead plane by the yarn shifting means.

In the preferred embodiment, a contact roll is mounted at a location between the yarn traversing means and the winding position so as to contact the circumference of the package being wound. Also, the slot means of the yarn shifting means preferably comprises a plate which includes a forward edge having a yarn retaining slot therein and which is positioned to retain the yarn in the bead plane. In one embodiment, the yarn displacing means of the shifting means comprises a second plate which is fixed to the first mentioned plate, and in another embodiment, the yarn displacing means comprises a laterally movable second plate.

The present invention makes use of the circumstance that on the one hand the yarn is deflected in the meaning of a considerable looping of the bobbin tube placed on the empty spindle, that on the other hand the yarn is also deflected in the necessary manner between the catching plane and the plane of the bead, and that finally just as a result thereof a considerable braking effect is also generated, which is necessary for the common rotation catching. As a result of the lateral deflection of the yarn, the tension decreases very considerably upstream of the yarn transferring device and the decreased tension continues up to the empty tube. However, upstream of the empty tube the yarn tension increases again, since the empty tube rotates in the same direction as the yarn. Thus, a "buckling" of the yarn occurs between the empty tube and the yarn transferring device, which is sufficient so that the yarn contacts the empty tube under no tension and can thereby be grasped all the more easily, and forms a kind of lap. The provision of a yarn catching slot can be of help in this operation.

The invention thus combines in a meaningful manner the function of the yarn guidance and the function of the yarn braking necessary for the catching in that looping angles totalling almost 360° are made possible.

The design and construction of the yarn transferring means so as to include a plate is advantageous in that the plate prevents the yarn or individual filaments of the yarn from becoming entangled. More particularly, the plate is moved between the full package and the empty tube at a time when the yarn is still untorn or uncut, and when the yarn is then torn or cut, the plate forms an effective protection of the empty tube and the first layers of yarn forming thereon against the yarn end projecting from the rotating full package.

Preferably, the yarn displacing means of the transferring device comprises a deflecting edge formed as a limiting edge of a slot provided in a second plate, with this second slot extending with its open end in the same normal plane as the yarn retaining slot of the first plate, but obliquely to the traversing direction, so that it extends between the plane of the bead and the catching plane.

The deflecting edge of the second plate can be rigidly connected with respect to the first plate, in which case it extends in the direction of the yarn retaining slot, but also with an axial component. In this embodiment, the yarn is tensioned automatically in the direction of the looping and axially between the catching plane and the bead plane, when the transferring device moves into the yarn path.

In some instances, there may be a risk that while the transferring device moves into the yarn path, the deflection of the yarn and the thereby generated braking effect are so considerable that the yarn tears before it is guided in the necessary manner into the catching plane on the one hand and into the bead plane on the other. To avoid this risk, a second embodiment may be employed wherein the deflecting edge can be moved relative to the plate along a direction substantially parallel to the traverse stroke. In this embodiment, the deflections in circumferential direction on the one hand and in axial direction on the other do not occur synchronously, but successively in that first the transferring device moves to its engaging position and then the deflecting edge is displaced.

It should be emphasized that the transferring mechanism of the present invention will be suitable not only for the common rotation catching, but also for the counter-rotation catching at a reversed direction of rotation of the revolver, if the path of the transferring mechanism extends with respect to the plane defined by the axis of the contact roll and the axis of the revolver, on the side to which the advancing yarn is directed from the contact roll. Preferably, the device is mounted at the free end of a rocking arm, and the rocking arm is pivotable about an axis parallel to the direction of the yarn traverse. Also, the pivotal axis is located on the side of the contact roll toward which the yarn advancing from the guide roll is directed. The mechanism is preferably removably attached to the rocking arm, which ensures that the transferring mechanism can be adapted to the geometric conditions of the yarn path, which are different in the common rotation and the counter-rotation catching.

It is also preferred that the mechanism be pivotally attached to the rocking arm, and controlled by the pivotal movement of the rocking arm such that the plate forms an angle less than about 45° with respect to the rocking arm in its idle position. This ensures that the transferring mechanism does not impede the winding of very large packages even under unfavorable geometric conditions.

The contact roll is movably supported with a component radial to the operating position, and rests movably on the package being formed during the winding operation. To ensure the mobility of the full package during a package doff, the contact roll can be raised while the package is doffed, so that a gap results between the full package and the guide roll, which enables the movement of the full package and the empty spindle.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE PREFERRED EMBODIMENTS

Figure 1A:
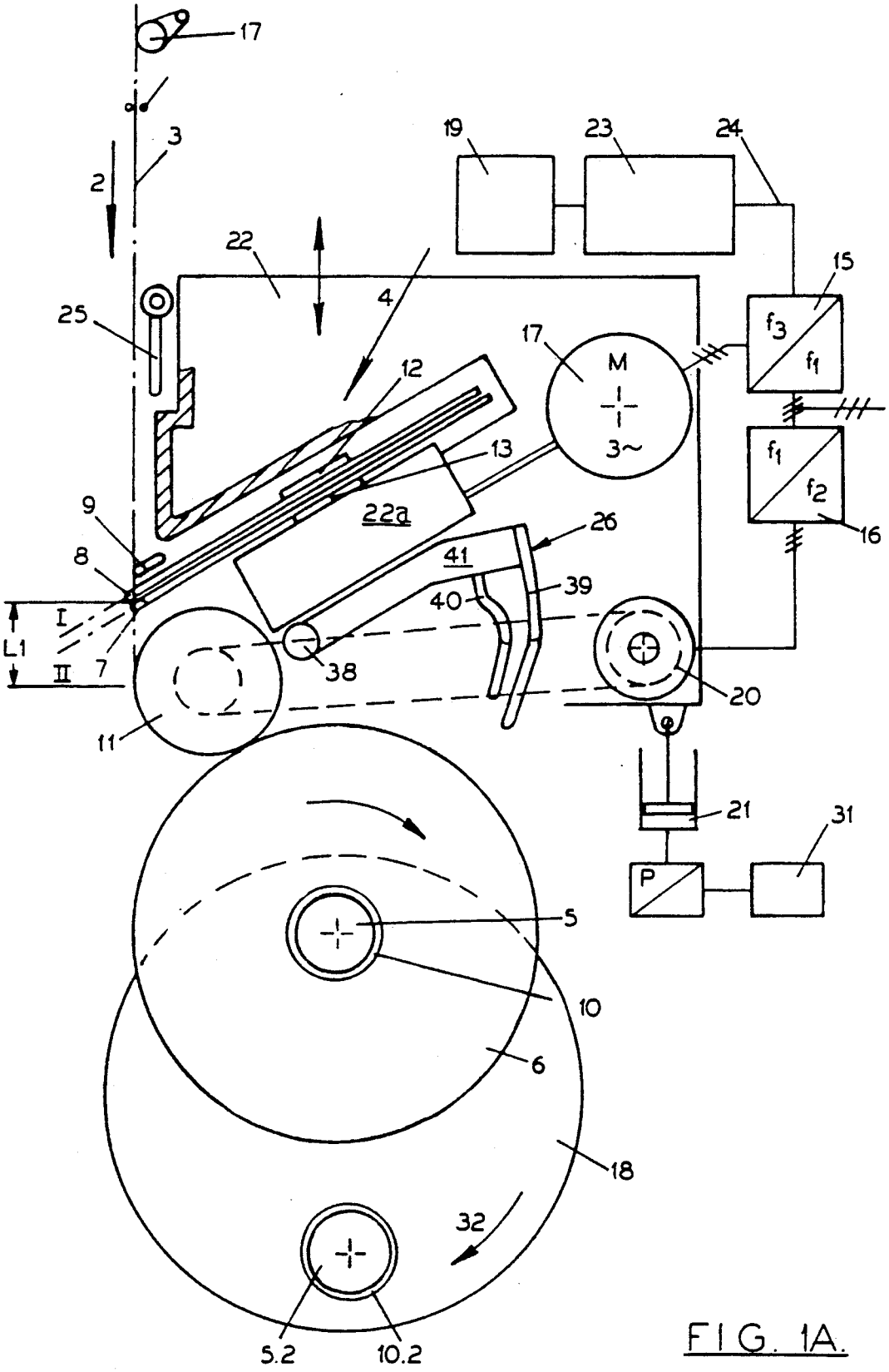
FIG. 1A is a side elevation view of a yarn winding apparatus which embodies the present invention.

In all embodiments of the illustrated yarn winding apparatus, a yarn 3 is continuously delivered by a feed system 17 at a constant speed. The yarn passes first through a yarn guide 1, which forms the apex of a traversing triangle. Then, the yarn advances in direction 2 to a yarn traversing mechanism, which will be described in more detail below. After the traversing mechanism, the yarn is deflected on a guide or contact roll 11 by more than 90° and then wound to form a package 6. The function of the contact roll is disclosed, for example in German Patent Application 35 13 796. It is advantageous that the contact roll be constantly operated at its nominal circumferential speed. This avoids that the speed of the contact roll decreases at the times when the package is doffed, and that the guide roll must be accelerated to its normal speed, when the contact with the package surface is restored. The drive motor necessary therefor can be a synchronous motor, which is driven during the phases of a package doff. In addition, the contact roll serves as a "print roll" for the guidance of the yarn on the package. Further, the contact roll serves to measure the circumferential speed of the package surface and to control the speed of the drive motors for the winding spindles, when the latter are directly driven by coaxial motors. To this end, reference is made, for example, to German Patent 34 25 064. However, the contact roll can also be constantly driven and serve as a drive roll for the drive of the package, as will be described below.

The package 6 is formed on a bobbin tube 10.1, which is placed on a rotatable spindle 5.1, i.e. the operating spindle. The package 6 is driven on its circumference by the contact roll 11. The contact roll is in turn driven by a package drive motor 20. The winding spindle 5.1 is shown in its operating position in FIG. 1A with a winding bobbin tube 10.1 placed thereon and a full package 6 formed on the latter. At this time, a second winding spindle 5.2 accommodating an empty bobbin tube 10.2 is in standby position. Both winding spindles 5.1 and 5.2 are freely rotatably supported in a rotatable revolver 18. The revolver 18 is rotatably supported in the frame of the takeup machine and rotated by a drive motor, so that the spindles 5.1 and 5.2 can alternately be moved to their operating or standby position respectively, when the package 6 is fully wound on one of the two spindles.

The yarn traversing mechanism 4 and the contact roll 11 are mounted on a slide 22, which is only partly indicated in the drawing. The slide is movable in vertical direction, so that the traversing mechanism and the contact roll can give way as the package diameter of the spindle in the operating position increases. The means for moving the yarn traversing mechanism and the contact roll is indicated in the drawing by a cylinder-piston assembly 21, which can be pneumatically biased, thereby compensating, fully or in part, the weight of the slide with the yarn traversing mechanism and the contact roll.

Further, the cylinder-piston assembly 21 can be pneumatically biased in such a manner that the slide moves upward, and a gap forms between the contact roll 11 and the full package 6, thereby avoiding that the movement of the full package and the empty spindle 5.2 is impeded during the package doff and rotation of the revolver. After the winding spindles are exchanged by the rotation of the revolver and the yarn is placed on the empty tube, the slide lowers again until the contact roll rests on the empty spindle or on the package forming thereon.

In the illustrated embodiment, the yarn traversing mechanism is a so-called rotary blade-type traversing system. It comprises two rotors 12 and 13, which are interconnected by a gearing **22*a* and driven by a motor 14. Mounted on the rotors 12 and 13 are blades 8 and 9, as can be seen in particular in FIGS. 2 and 3. The rotors rotate in different directions 27, 28, and in so doing guide the yarn along an edge 9**, with the one blade taking over the guidance in the one direction, and then moving below the other guide edge, while the other blade takes over the guidance in the other direction and then moves below the guide edge. A rotary blade traversing system of this type is further disclosed in U.S. Pat. No. 4,505,436 and corresponding to European Patent 114,642.

In the illustrated embodiments, the contact roll 11 drives the packages at a constant circumferential speed. To this end, the contact roll 11 is connected with a package drive motor 20. A frequency generator 16 drives package drive motor 20 at a constant speed. The traversing motor 14 is driven by a frequency generator 15 at a constant speed, the frequency generator 15 being controllable by a controller 23 as a function of signals emitted by a program transmitter 19.

In addition, the spindles 5.1 and 5.2 can be driven by starting motors 29.1 and 29.2. Each starting motor 29.1 or 29.2 is attached to the revolver 18 in alignment with the spindles. The starting motors are supplied with a three-phase current of a controllable frequency by frequency transmitters 30.1 and 30.2. The frequency transmitters 30.1 and 30.2 are triggered by controller 31, which supplies command signals to the respective devices of the winding apparatus according to a package doff program, including the pressure converter for the actuation of the cylinder-piston assembly 21.

Figure 2:
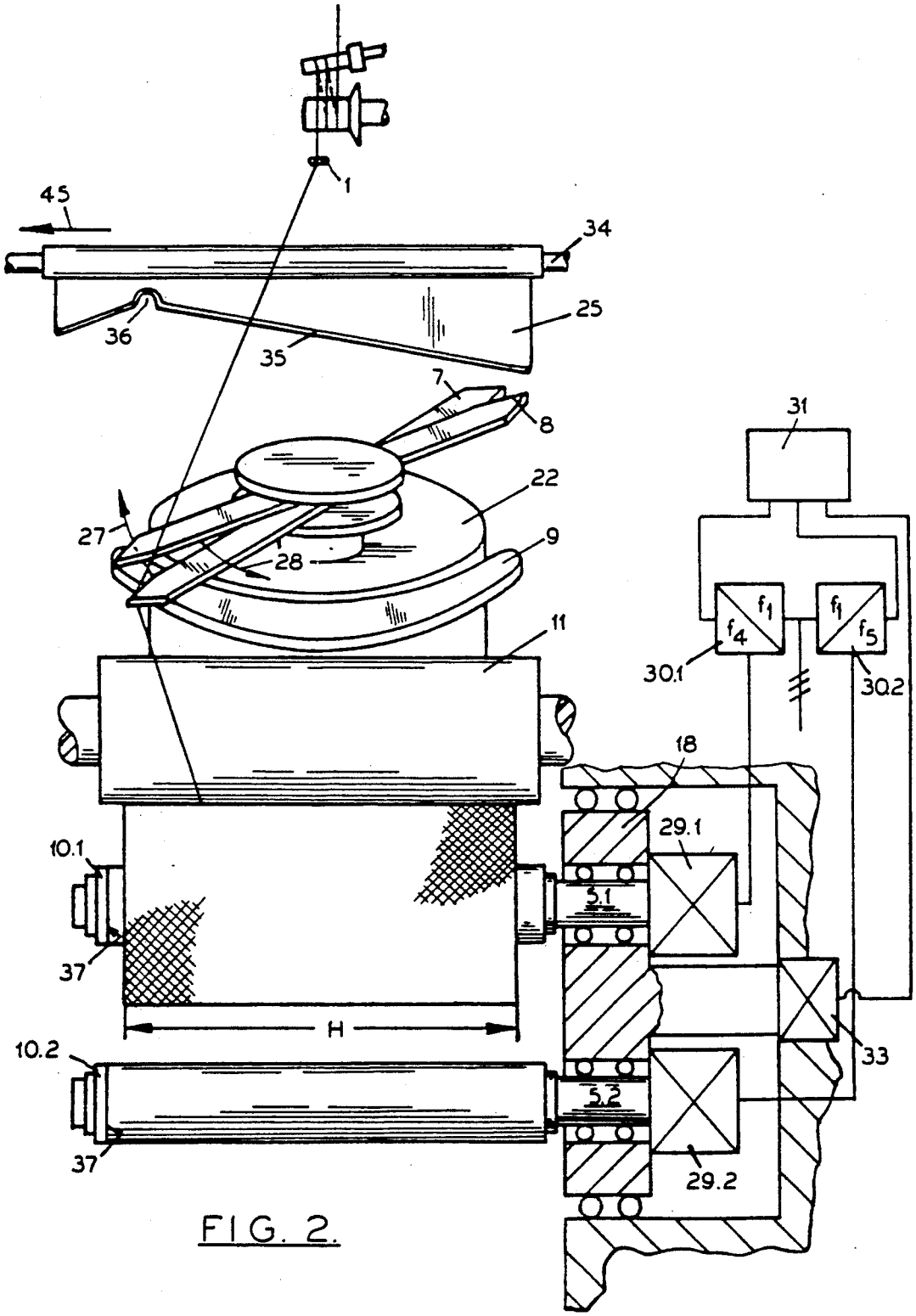
FIG. 2 is a front elevation view of the apparatus.

Shown in FIGS. 1A and 2 is the operating position of the winding spindle 5.1, with the package 6 almost full. In the operating position of all embodiments, the yarn lifting device 25 and yarn shifting mechanism 26 are both in their idle position.

The following description of the package doff applies to all embodiments. First, the empty spindle 5.2 on standby is started. To this end, the controller 31 triggers the frequency transmitter 30.2, which supplies starting motor 29.2 with a three-phase current, in such a manner that the empty tube 10.2 placed on spindle 5.2 is driven at the same circumferential speed as is the contact roll 11. At the same time, as the frequency transmitter 30.1 is triggered, and the starting motor 29.1 of the operating spindle 5.1 is put in operation at a speed which corresponds to the present speed of the operating spindle at the increased diameter of package 6.

The revolver 18 is then rotated respectively in the indicated direction of arrow 32 by controlling the revolver motor 33. At the same time, the cylinder-piston assembly 21 is biased by such a high pressure that the slide with yarn traversing mechanism 4 and contact roll 11 move upward and the circumferential contact between the full package and the contact roll 11 is discontinued.

The revolver is now rotated to such an extent that the empty spindle reaches its operating position and the operating spindle arrives in its standby position, as is shown in FIGS. 1B, 4, 7, and 8. It should be noted that at this stage there is still no contact with the contact roll 11. As it enters into its operating position, the empty spindle 5.2 with winding tube 10.2 placed thereon is moved into the yarn path extending between the contact roll 11 and the full package 6. In so doing, the yarn is still reciprocated by the traversing mechanism 4 and, consequently, wound on the full package 6 over at least approximately the entire traversing stroke H.

Figure 1B:
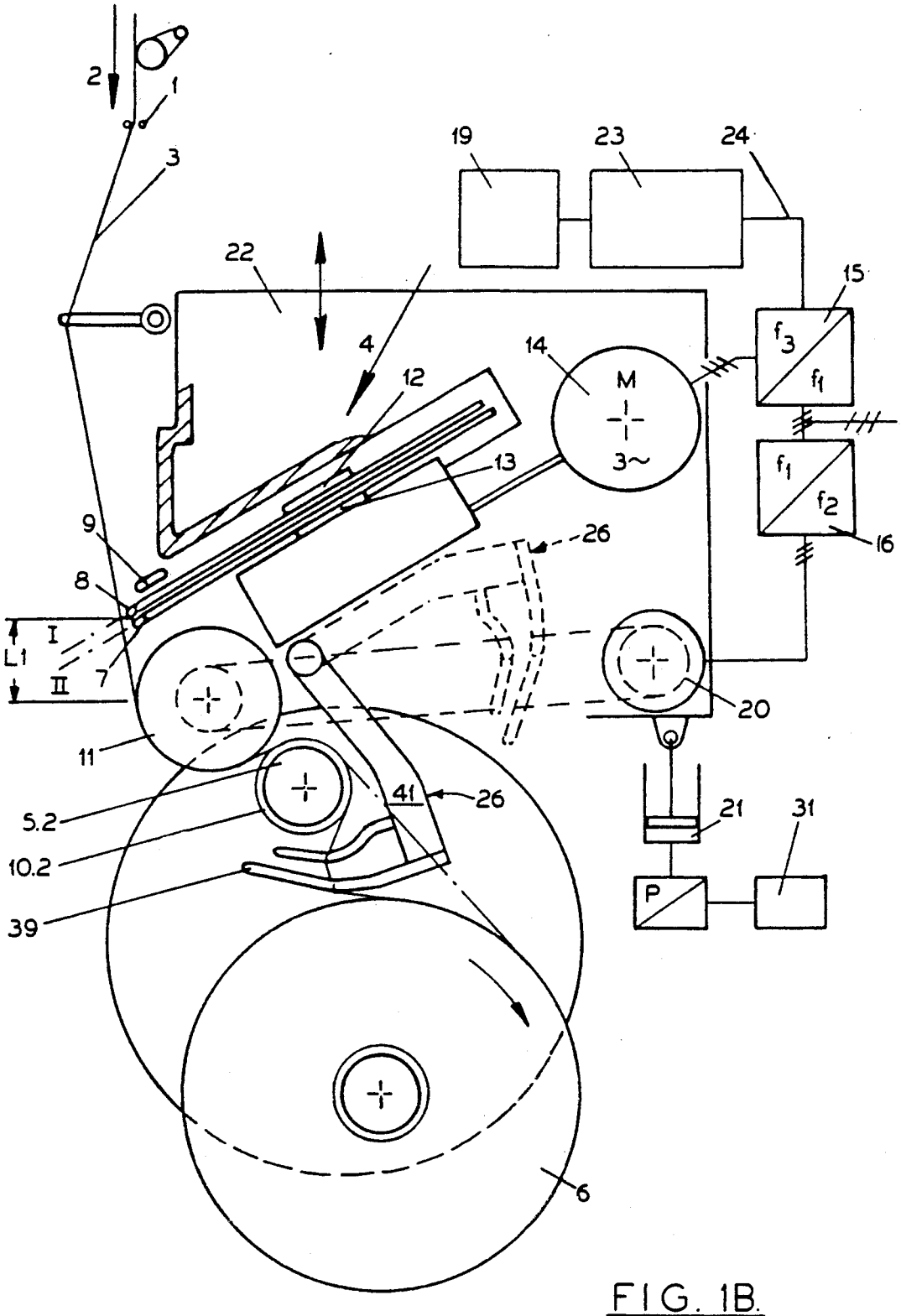
FIG. 1B is similar to FIG. 1A but illustrating the apparatus during a package doffing operation.

Next, the yarn lifting device 25 moves forward. In all embodiments, the yarn lifting device is only shown by way of example, and it is possible to use other designs. In FIGS. 2, 3A, 5A, and 6A, the yarn lifting device 25 is illustrated rotated by 90° to give a better view of its operating method. The yarn lifting device comprises an axis of rotation 34, which extends parallel to the yarn traversing mechanism, to the axis of the contact roll, and to the axes of the winding spindles. Its V-shaped front edge 35 intersects with its two legs the axis of rotation 34, and forms in its moved-out position (FIG. 1B) two guide edges extending obliquely to the yarn traversing mechanism and converging at a guide notch 36. As the yarn lifting device 25 swings out, the yarn is moved out of the zone of contact with the rotary blades 7, 8 of the yarn traversing mechanism 4, so that it becomes entirely disengaged (FIG. 1B). As a result, the yarn slides along one of the oblique guide edges 35 and enters into the notch 36. The guide notch 36 initially extends in a normal plane of the winding spindle, which is within the traversing stroke. However, the yarn lifting device can also be displaced along its axis of rotation 34 in direction of arrow 45 (FIGS. 2, 3A), until the guide notch 36 extends in a normal plane, in which each bobbin tube 10.1 or 10.2 has a yarn catching slot 37.1 or 37.2. In the present application, this normal plane is described as the catching plane. The catching slot is a narrow notch formed in the surface of the winding tube, which extends in a normal plane over a portion, or the entire circumference, thereof and may have a special shape, which will be described below. It should be mentioned that the yarn catching slot 37 and the yarn catching plane, are located outside of the traversing stroke H, over which the winding tube is normally wound.

Along with the yarn lifting device, the yarn shifting mechanism 26 is rotated. Its axis of rotation 38 extends parallel to the axis of rotation of the contact roll 11 and spindles 5.1, 5.2. The yarn shifting mechanism comprises a rocking lever 41, the free end of which accommodates the transferring devices, which include two plates 39, 40. These plates will be described below with reference to individual embodiments. The axis of rotation 38 extends in such a way, and the length of lever 41 and its shape are selected such that the plates 39, 40 can be moved between the circumference of the empty spindle 5.2 moved to its operating position and the full package 6 moved to its standby position.

Figures 3A, 3B:
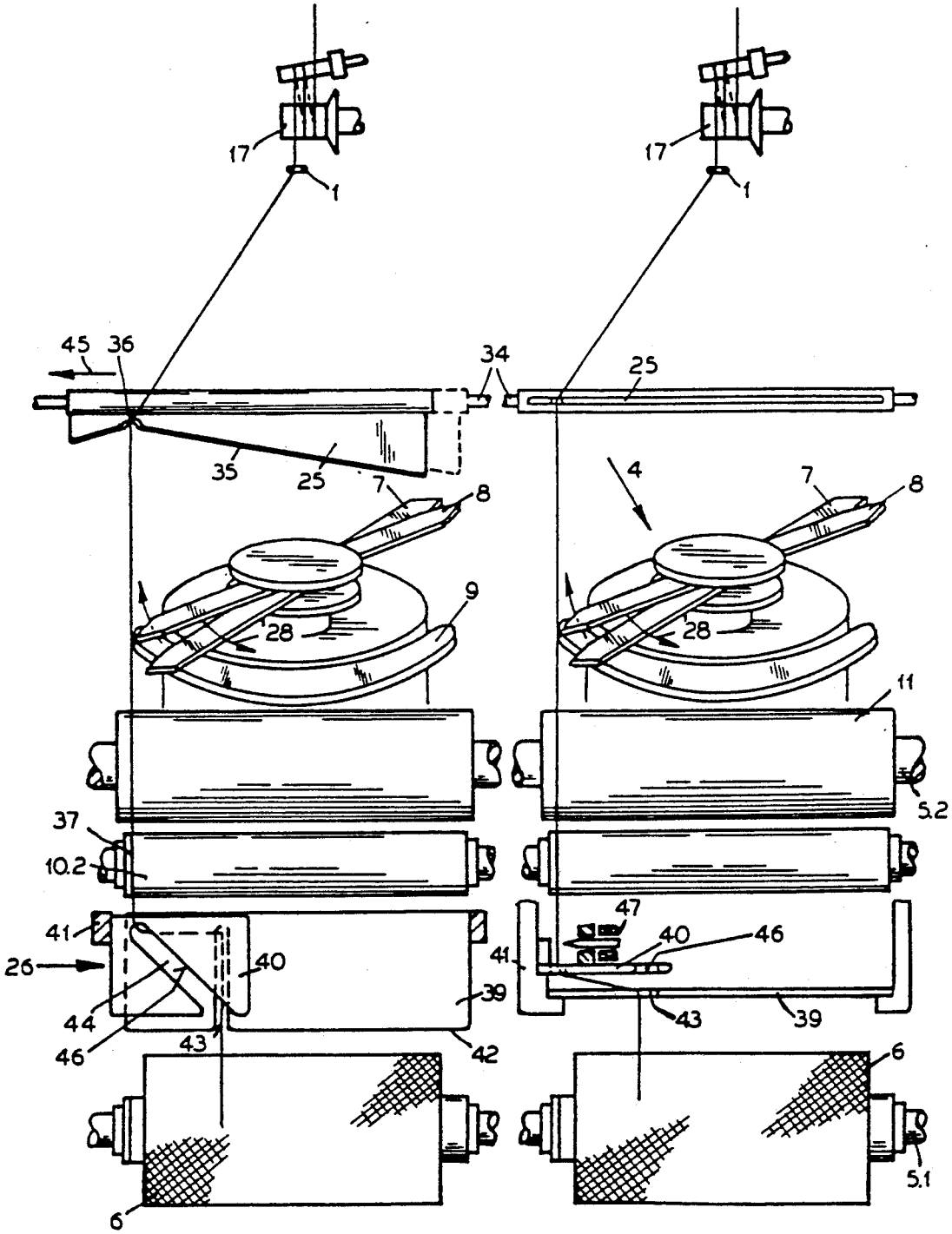
FIG. 3A and 3B are front elevation views of a second embodiment, shown during a package doffing operation.

For the first embodiment, reference is made to the shifting mechanism as shown in FIGS. 3A–B. The shifting mechanism comprise two plates 39, 40, which are mounted at a fixed distance from each other. The shape of the two plates is shown in FIGS. 3A and 3B. It should be mentioned however that their real front view is illustrated in FIG. 3B. FIG. 3A differs therefrom only in that, for a better illustration, the yarn lifting device 25 and the yarn shifting mechanism device 26 are shown each rotated by 90°.

As is shown in FIG. 3B, the plate 39 is in its pivoted position between the empty spindle 5.2 and the full package 6, when viewed in the direction of the advancing yarn. The front edge of the plate, i.e., the edge which contacts the yarn first when it is pivoted, is formed as a slide edge 42. A yarn retaining slot 43 is provided which is perpendicular to this slide edge 42. The slot 43 extends in a normal plane, which intersects the full package 6, i.e., the traversing stroke H, but is located close to the end and in the vicinity of the yarn catching slot 37 provided in the bobbin tube. In the present application, this plane is referenced as the bead plane, because in this normal plane a yarn bead comprising several windings is formed on the full package as the winding thereof comes to an end.

A recess 44 is provided in the plate 40, which extends, when viewed in the direction of the advancing yarn, above the retaining plate 39. This recess extends obliquely with respect to the slide edge 42 and the direction of the yarn traverse, and defines an obliquely directed guide edge 46. The opening of recess 44 on the front side of the plate 40 extends in the same normal plane as the opening of the retaining slot 43. However, the end of the recess 44 extends in the normal plane in which the yarn catching slot 37 of the empty tube 10.2 is located, i.e. the yarn catching plane.

Referring now to the situation, when the yarn lifting device 25 is moved out and the yarn shifting mechanism 26 is pivoted to the position shown in FIG. 2 as well as in FIG. 3B, the yarn first slides along the V-shaped guide edge 35 of the lifting device. Simultaneously, the yarn slides also along the edge 42 of plate 39 and enters into the guide notch 36 of the lifting device 25 and into the retaining slot 43 of the shifting mechanism 26. It should be emphasized that in so doing the guide notch 36 and the retaining slot 43 initially extend substantially in the same normal plane. Now, the lifting device 25 is displaced toward one package end, at which the catching slot 37 is located, i.e., in direction of arrow 45, until the guide notch 36 lies in the normal plane in which the catching slot 37 of the empty tube 10.2 is also located, i.e. the yarn catching plane. While the yarn lifting device 25 moves in the direction of arrow 45, the yarn slides along the guide edge 46 of the recess 44, and the yarn is thereby forced into the catching plane in the zone of the yarn path between the empty spindle and the retaining slot 43. As is shown in FIG. 3B, the yarn shifting mechanism 26 thus causes the yarn to move in the catching plane between the lifting device 25 and the yarn shifting mechanism, and then to move into a normal plane, i.e the bead plane, of the full package. As a result, the yarn advancing in the catching slot 37 of the empty spindle 5.2 is now caught by the slot. If it is a low-denier yarn, the yarn will tear. Otherwise, a yarn cutter comprising an anvil and a blade 47 can be actuated in this moment. The anvil and the blade are mounted on plate 40 in an area of the end of recess 44 and the catching plane.

Figure 4:
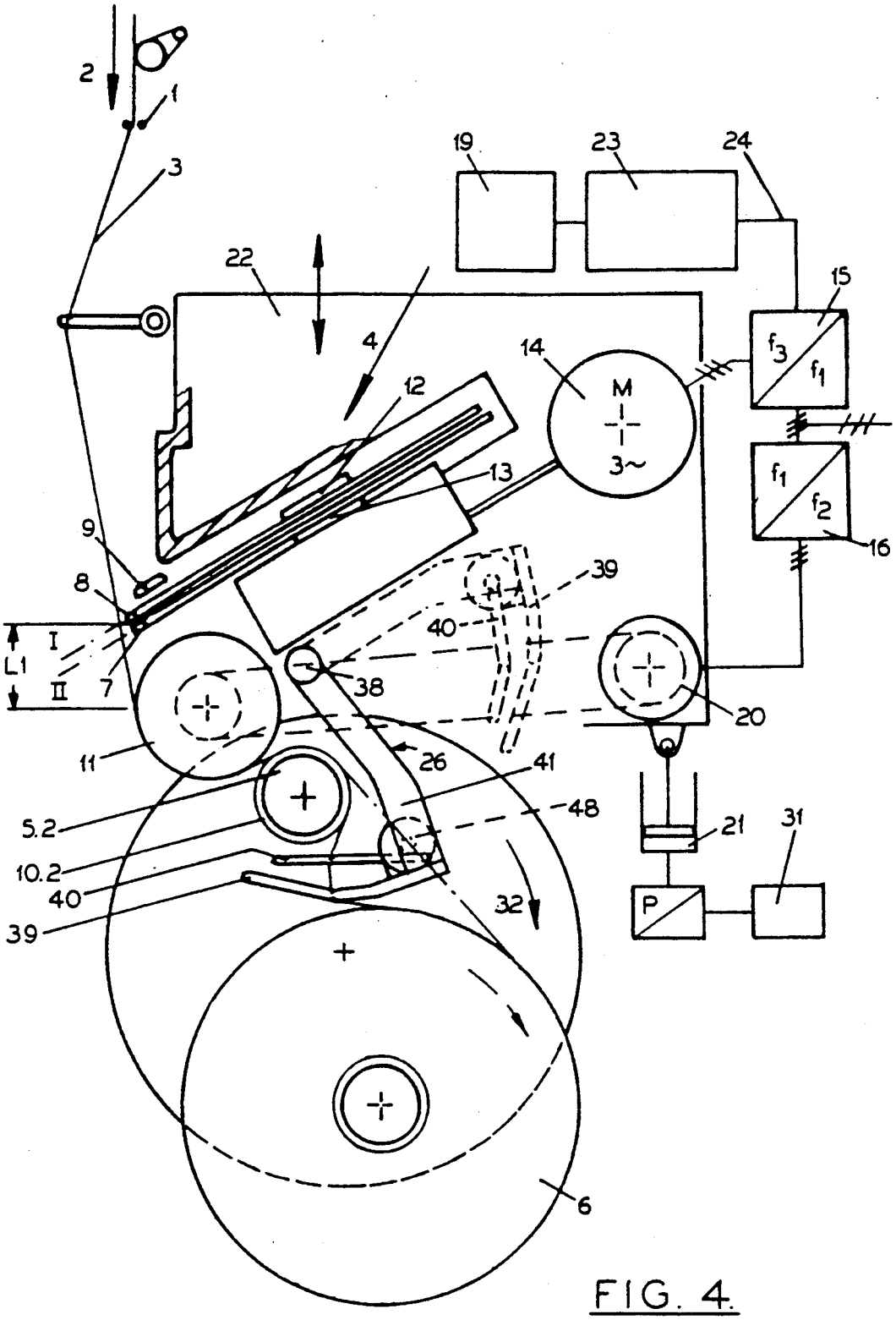
FIG. 4 is a view similar to FIG. 1B but of still another embodiment.
Figures 6A, 6B:
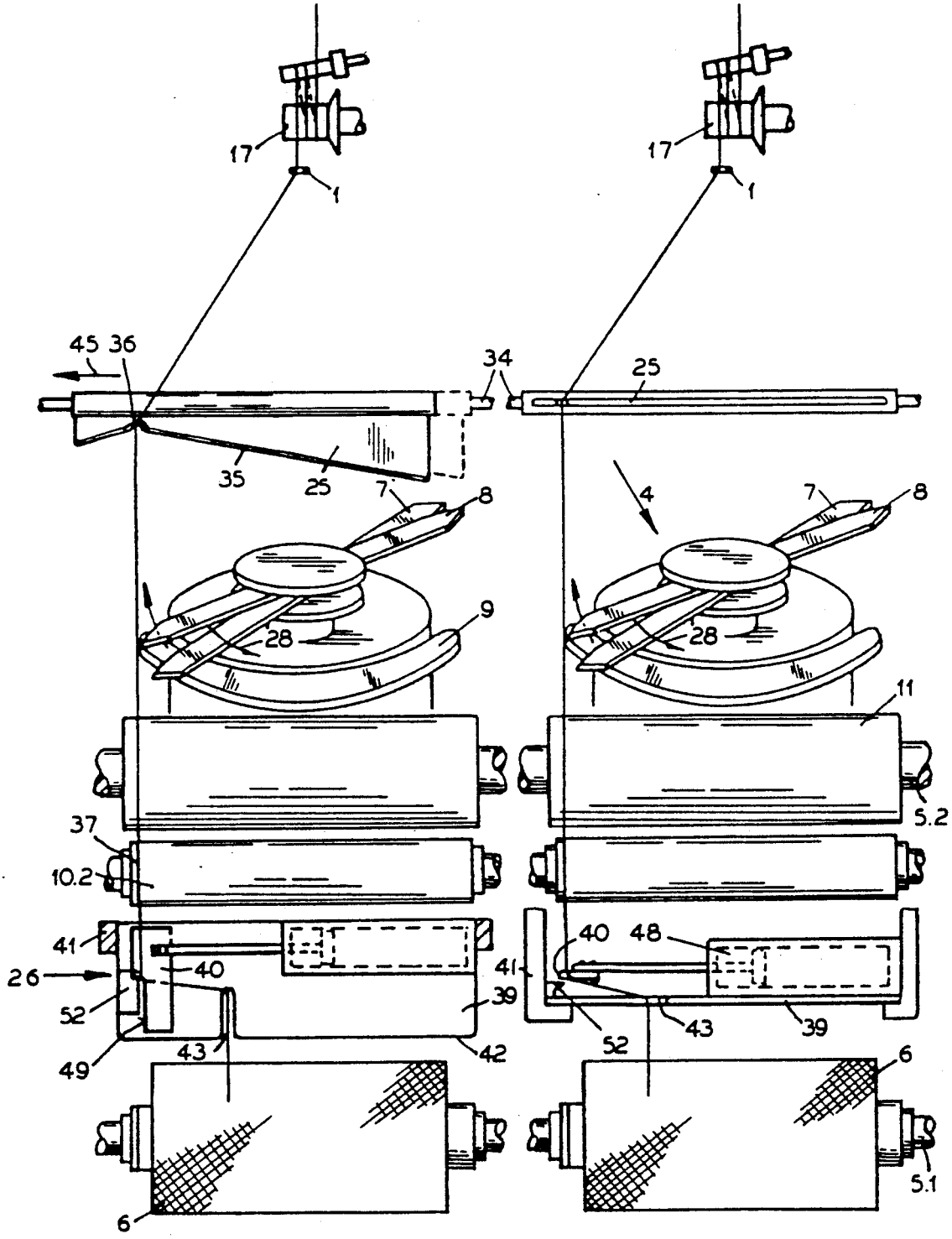
FIGS. 6A and 6B are front elevation views of the apparatus of FIG. 4 during a second phase of the package doff.
Figure 7:
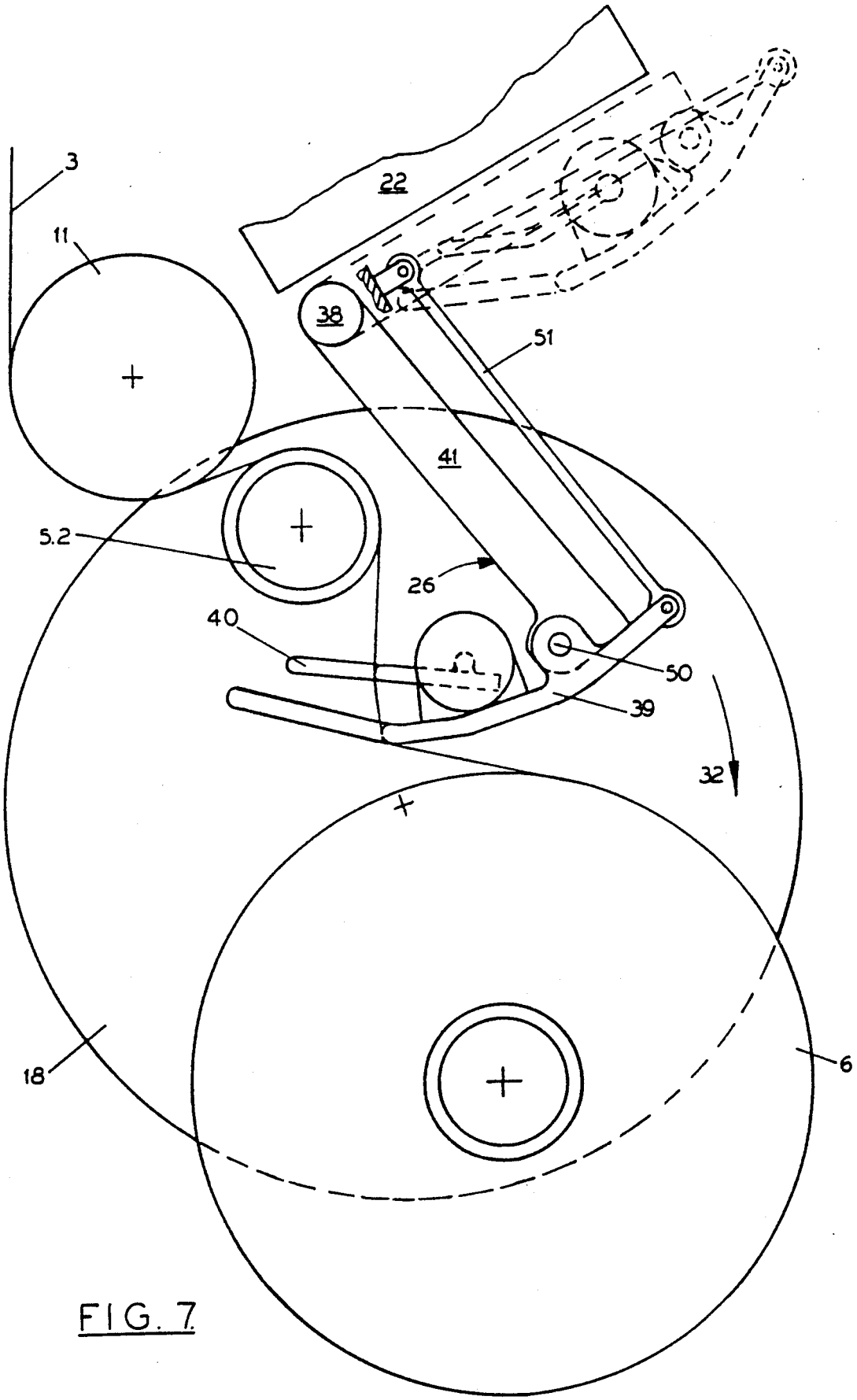
FIG. 7 is a view similar to FIG. 1B but of a further embodiment.

Both in the embodiment illustrated in FIGS. 4–6 and the further embodiment of FIG. 7, the plates 39 and 40 serve as yarn shifting devices. The plate 39 is attached to the rocking arm 41. The plate 40 is likewise pivoted with rocking lever 41, but also axially displaceable thereto. To this end a cylinder-piston unit 48 is used, which is mounted on the rocking arm 41.

The piston with its rod is movable parallel to the axes of the spindles. The shape of the two plates 39, 40 and their function can be seen in FIGS. 5A–B and 6A–B, which also apply to the embodiment of FIG. 7. While FIGS. 5B and 6B show their real front, the FIGS. 5A and 6A differ only in that for a better illustration the yarn lifting device 25 and the yarn shifting mechanism 26 with plates 39, 40 are each shown rotated by 90°.

Figures 5A, 5B:
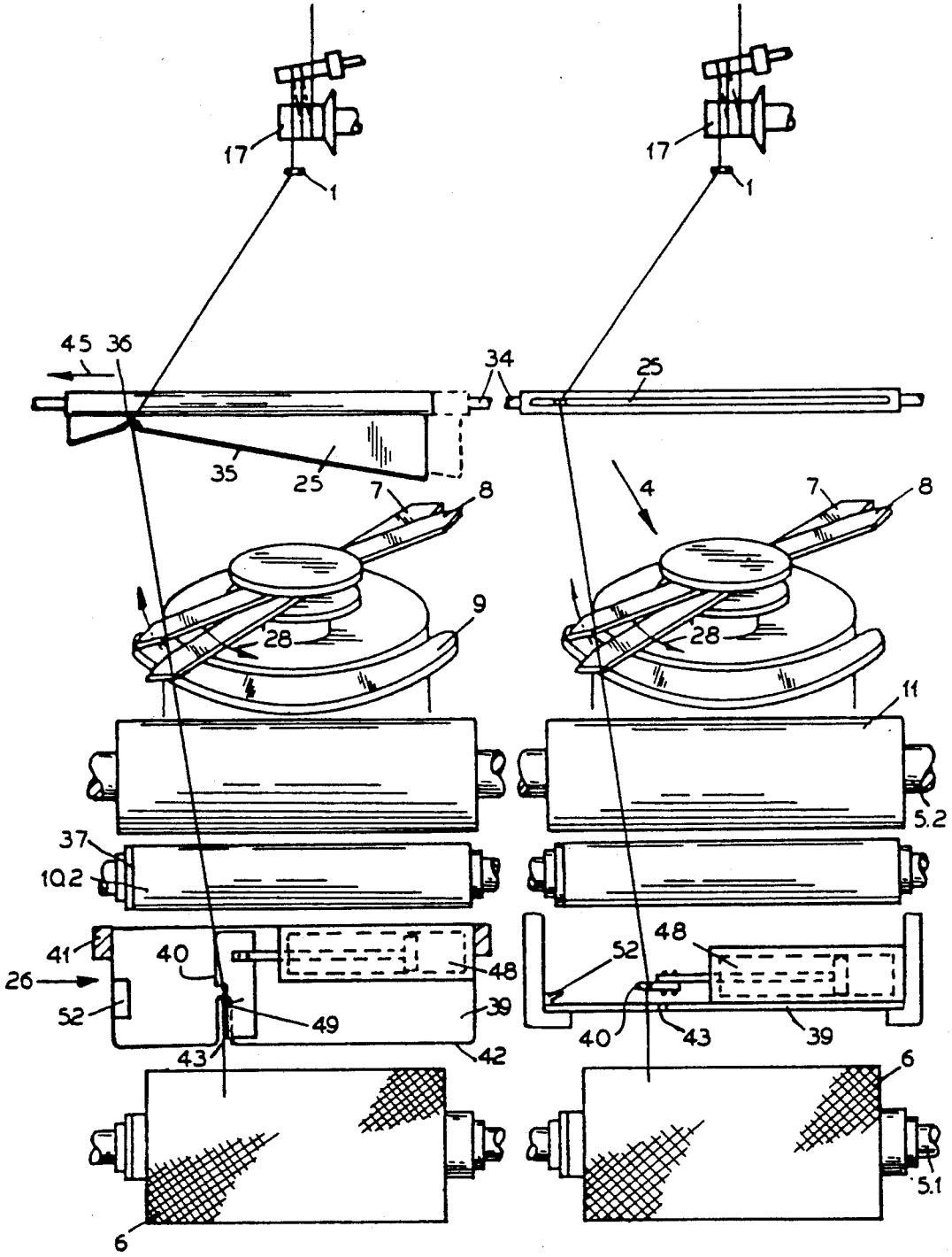
FIG. 5A and 5B are front elevation views of the apparatus of FIG. 4 during the first phase of a package doff.

As is shown in FIGS. 5B and 6B, the plate 39 is at the bottom in its pivoted position between the empty spindle 5.2 and the full package 6, when viewed in the direction of the advancing yarn. The front edge of the plate, i.e. the edge, which contacts the yarn first, is formed as a slide edge 42, and the retaining slot 43 is perpendicular to this slide edge 42. The slot 43 extends in a normal plane, which still intersects the full package 6, i.e. its traverse stroke H, but is located close to the end and in the vicinity of the yarn catching slot 37 provided in the tube, i.e. bead plane. When viewed in the direction of the advancing yarn, the plate 40 is movable above the plate 39 and perpendicular to the retaining slot 43. On its front side it is provided with a guide edge 49 serving as a deflecting edge, which extends substantially parallel to the retaining slot 43. In its retracted position of FIGS. 5A–B, the guide edge 49 releases the retaining slot 43, so that the yarn can enter into the slot 43 without any substantial deflection. In the moved-out position of the cylinder-piston assembly 48, the guide edge 49 passes over the slot 43, so that the yarn guided and held therein is laterally deflected, as is shown in FIGS. 6A–B. In so doing, the cylinder-piston assembly 48 can move out the guide edge 49 to such an extent that the yarn is guided at least approximately to the yarn catching plane, i.e. in the plane in which the catching slot 37 provided in the empty tube is located. The plate 40 is moved out only when the shifting mechanism with plate 39 is moved substantially completely to its contacting position and the yarn is entered substantially completely into the retaining slot 43.

As can be seen in FIG. 6, the plate 40 with guide edge 49 can cooperate with a cutting blade 52, which is attached to the shifting mechanism at the end of the path travelled by the guide edge 49. In order to place the yarn into the catching slot 37 of the empty tube 10.2, the guide edge 49 moves closely to the cutting blade 52, so that the yarn is first guided along the edge 49 and the edges of slot 43 and supplied to the full package 6. Then the guide edge 49 moves over the blade 52 thereby acting as scissors, so that the yarn is cut.

As can be seen in both FIG. 3B and FIG. 6B, the yarn is considerably deflected by the device of the present invention between the empty spindle 5.2, on which the yarn is to be placed, and the full package 6. To this end, the yarn is on the one hand deflected, when viewed in the projection on a normal plane, at the bottom of the retaining slot 43 and the bottom of the recess 44 by a total of approximately 120°. In addition, a deflection occurs parallel to the direction of the traverse, as shown in the projection of FIGS. 3B and 6B, there being again a total looping angle of more than 120°. The plates which form a part of shifting mechanism 26, thus do not only effect a guidance of the yarn suitable for the proper working of the transfer, but at the same time also a deflection influencing the yarn tension, which leads to a reliable catching of the yarn, inasmuch as in this situation the yarn continues to be withdrawn by the full package 6 thereby considerably decreasing the tension upstream the yarn transferring mechanism 26. However, in the case of the common rotation catching, this decrease of the yarn tension continues only to the winding tube 10.2 on the empty spindle 5.2, since this winding tube moves in the same direction as the yarn and consequently advances the yarn. As a result, the winding tube 10.2, which is placed on the empty spindle 5.2, builds up again a high tension in the upstream direction of the yarn. This avoids the risk that the yarn slackens on further upstream located deflecting points, for example, in notch 36 or yarn guide 1, and forms a lap on the feed system 17. Thus, the yarn shifting mechanism of the present invention accomplishes a controlled reduction of the yarn tension downstream the empty tube 10.2, on which the yarn is to be placed. This reduced yarn tension permits the yarn to form a lap on the empty tube, thereby facilitating the catching of the yarn.

As noted above, the embodiment of FIG. 7 corresponds with regard to the operation of the shifting mechanism to the embodiment of FIGS. 4–6. However, the embodiment of FIG. 7 distinguishes itself in that is comprises means which allow the plates of the shifting mechanism to fold in a space saving manner, when it is nonoperative. To this end, the plate 39 is pivotally supported on a post 50 provided adjacent the free end of the rocking arm 41. The plate 40 is attached to plate 39. The plates 39, 40 can be jointly moved so that they extend substantially parallel to the rocking arm 41. To this end, a parallel linkage bar 51 is provided in the embodiment, which is pivotally joined at its one end to the slide 22 close to the axis of rotation 38, and to the plate 39 at its other end. This parallel bar allows the plate 39 and the plate 40 to pivot in such a manner, that they extend in the idle position of the rocking arm 41 substantially parallel, and in the contacting position at a large angle of up to 90° to the rocking arm 41.

The embodiments described with reference to FIGS. 1–7 distinguish themselves in that they are operated on the principle of the common rotation yarn catching. In the common rotation catching method, the empty tube 10.2 moves in the contacting stage in the same direction as the yarn. The resulting advantages have been described above. A common rotation catching is realized in that the revolver 18 is rotated in a certain direction 32 as indicated in FIGS. 1A and 4, when a full package is to be moved to the standby position. This rotational direction is the same as the direction of the spindles during the winding.

Figure 8:
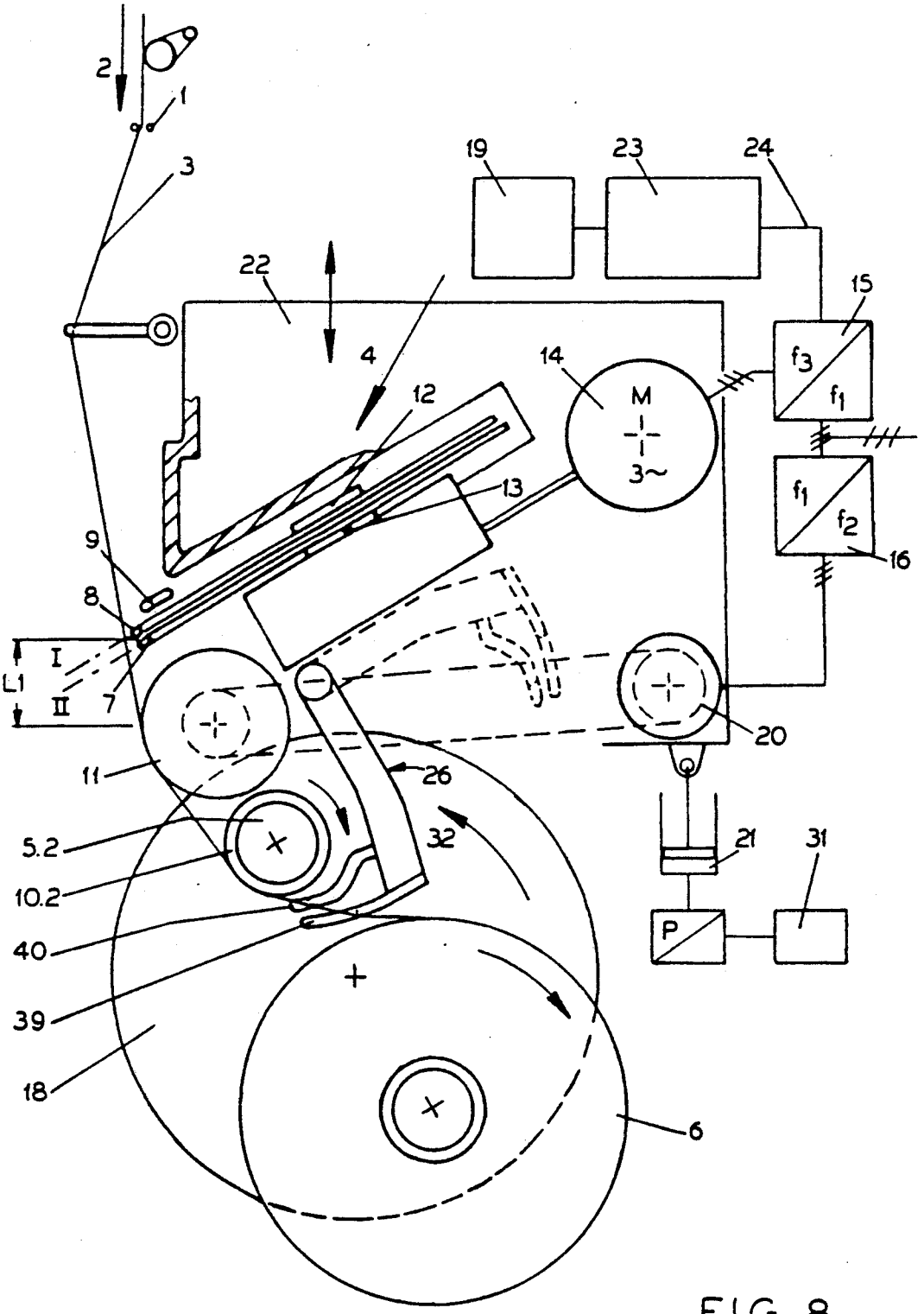
FIG. 8 is a side elevation view of an embodiment adapted for the counter-rotation yarn catching procedure.

FIG. 8 illustrates that the automatic yarn transferring means of the present invention can also operate a winding apparatus on the principle of a counter-rotation catching, without requiring any constructional modifications on the winding apparatus itself. This is based on the fact that the yarn shifting mechanism is arranged and constructed in such a manner that it does not interfere with the rotational movement of the revolver with the winding spindles and packages, but, nonetheless, can be effectively engaged. To this end, the path traveled by the shifting mechanism is located on the side of the revolver, in which the yarn advancing from the contact roll is directed. When using the common rotation catching method, the shifting mechanism is permitted to pass through the common tangential plane defined by the surfaces of the full package and empty tube, and in so doing deflects the yarn traveling in this tangential plane in the direction of a considerable looping about the empty tube. In the counter-rotation catching method, in which a considerable looping of the empty tube is less important, the shifting mechanism can likewise perform the necessary yarn deflecting operation between the catching plane and the bead plane, without being an obstacle on the servicing front of the machine.

A slight geometrical modification of the shifting mechanism with the plates 39 and 40 may be necessary for an adaptation to the changed yarn path. To this end, it is possible to exchange the plates on the rocking arm or the rocking arm with the plates. The operation of the shifting mechanism, however, remains unchanged. The doffing operation of the package is as described above.

In the drawings and specification, there has been set forth a preferred embodiment of the invention, and although specific terms are employed, they are used in a generic and descriptive sense only and not for purposes of limitation.

We claim:

1. An apparatus for continuously winding an advancing yarn onto bobbin tubes serially delivered to a winding position, and comprising a revolver rotatably mounting at least two spindles having parallel rotational axes, with each spindle being adapted to mount at least one bobbin tube coaxially thereon, and such that each spindle and associated bobbin tube may be selectively moved between a winding position and a doffing position upon rotation of said revolver, means for winding an advancing yarn onto a bobbin tube at the winding position and including means for rotating the spindle and associated bobbin tube at the winding position, and traversing means mounted at a location upstream of a winding position for traversing an advancing yarn to form a cross wound package, rotary drive means for selectively rotating said revolver to move each spindle between said winding position and said doffing position, and means for automatically transferring the advancing yarn from the rotating full package which has been moved to the doffing position, to a rotating empty bobbin tube on a spindle which has been moved to the winding position, and comprising (a) yarn lifting means for selectively removing the advancing yarn from the traversing means and then conveying the advancing yarn laterally to a yarn catching plane which is perpendicular to the axes of said spindles and which is located beyond the normal traverse stroke, and (b) yarn shifting means which is selectively movable into an operative position extending into the yarn path between the empty bobbin tube and the full package, and which includes slot means for engaging the advancing yarn and retaining the same in a bead plane which is parallel to said catching plane and is within the normal traverse stroke and so that the yarn advances to the rotating full package in said bead plane, and yarn displacing means positioned upstream of said slot means for conveying the advancing yarn laterally from said slot means to said yarn catching plane, and such that the advancing yarn runs in said yarn catching plane from said yarn lifting means to said shifting means and so as to be adapted to engage a yarn catching slot in the rotating empty bobbin tube at said winding position and which is located in said yarn catching plane, and the advancing yarn is then deflected laterally from said yarn catching plane to said bead plane by said yarn shifting means.

2. The winding apparatus as defined in claim 1 further comprising a contact roll mounted at a location between said traversing means and the winding position and so as to be in circumferential contact with the package being wound and so that the advancing yarn partially loops about said contact roll in a direction opposite to the direction the advancing yarn is wound upon the bobbin tube at the winding position.

3. The winding apparatus as defined in claim 2 wherein said slot means comprises a plate which includes a forward edge which extends generally parallel to said spindle axes, and a retaining slot formed in said forward edge and which extends rearwardly therefrom along said bead plane.

4. The winding apparatus as defined in claim 3 wherein said yarn displacing means of said yarn shifting means comprises a second plate which is fixed in a parallel relationship with said first mentioned plate, and with said second plate defining a forwardly directed guide edge which extends from said bead plane to said yarn catching plane.

5. The winding apparatus as defined in claim 3 wherein said yarn displacing means of said yarn shifting means comprises a second plate having a laterally directed guide edge, and means for laterally moving said second plate between a first position wherein said guide edge is generally aligned with said retaining slot and a second position wherein said guide edge is generally aligned with said yarn catching plane.

6. The winding apparatus as defined in claim 3 wherein said yarn shifting means is pivotally mounted for selective movement between said operative position and an inoperative position withdrawn from the normal yarn path, and wherein said pivotal mounting defines a pivot axis which is parallel to the axes of said spindles and is located on the side of the plane defined by the axes of said contact roll and said revolver toward which the yarn advances from said contact roll.

7. The winding apparatus as defined in claim 6 wherein said yarn shifting means further includes a rocker arm having one end which is mounted for pivotal movement about said pivot axis, and an opposite end, and with said plate being mounted to said opposite end.

8. The winding apparatus as defined in claim 7 wherein said yarn shifting means further comprises linkage means for pivotally mounting said plate to said opposite end of said rocker arm so that the plate pivots with respect to said rocker arm during pivotal movement of said rocker arm, and between a retracted position which is generally parallel to said rocker arm when said rocker arm is in said inoperative position, and an extended position which is generally perpendicular to said rocker arm when said rocker arm is in said operative position.

9. The winding apparatus as defined in claim 6 wherein said yarn lifting means comprises a plate which is mounted for pivotal movement about an axis parallel to said pivot axis of said yarn shifting means, and wherein said plate of said lifting means is located upstream of said yarn traversing means.

10. The winding apparatus as defined in claim 2 further comprising means mounting said contact roll so as to permit movement of said contact roll in a radial direction with respect to the package being wound at the winding position, and means for selectively moving said contact roll along said direction of movement.

11. The winding apparatus as defined in claim 10 further comprising drive motor means for positively rotating said contact roll.

* * * * *